United States Patent [19]

Taylor

[11] Patent Number: 4,984,399

[45] Date of Patent: Jan. 15, 1991

[54] AUTOMOBILE ENCLOSURE

[76] Inventor: Gary L. Taylor, 715 S. Upas St., Escondido, Calif. 92025

[21] Appl. No.: 542,757

[22] Filed: Jun. 25, 1990

[51] Int. Cl.[5] ..... E04B 7/16; E04B 1/346; E04H 6/00

[52] U.S. Cl. ..... 52/64; 52/79.1; 52/66; 160/113; 160/189; 160/201

[58] Field of Search ..... 52/64, 66, 79.1; 160/113, 189, 201

[56] References Cited

U.S. PATENT DOCUMENTS

| | | | |
|---|---|---|---|
| D. 216,959 | 3/1970 | Heiser | D13/1 |
| 2,742,674 | 4/1956 | Medler | 20/1.13 |
| 3,203,143 | 8/1965 | Swenson | 52/64 |
| 3,438,158 | 4/1969 | Kane | 52/64 |
| 3,600,866 | 8/1971 | Griffith | 52/64 |
| 4,133,148 | 1/1977 | Swenumson | 52/64 |

*Primary Examiner*—David A. Scherbel
*Assistant Examiner*—Manoj Samant
*Attorney, Agent, or Firm*—Calif Kip Tervo

[57] ABSTRACT

A portable, strong, lightweight, low-height automobile housing or garage encloses an automobile on five sides. A roll up rear door provides for entry of an automobile. The driver side wall and roof include have a side access opening extending through them such that a driver taller than the roof of the enclosure can ingress and egress the driver door in a normal standing manner. A roll up side door is moveable between an closed position closing the side access opening to an open position disposed under the roof and along the passenger side wall. Side and rear doors opens simultaneously. The door opening, closing, and locking mechanism is a pair of cable winches mounted on a shaft, each with a cable attached to the door. One winch for opening and one for closing a door. The cables are counter wound on the drums so that as one calbe is played out as the other is taken in. Thus the door may not move in either direction unless the cable drums are turned.

21 Claims, 2 Drawing Sheets

FIG. 3
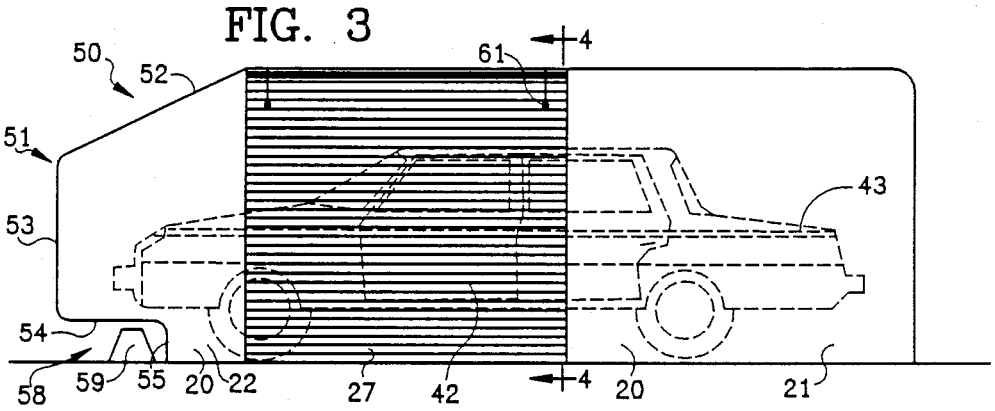
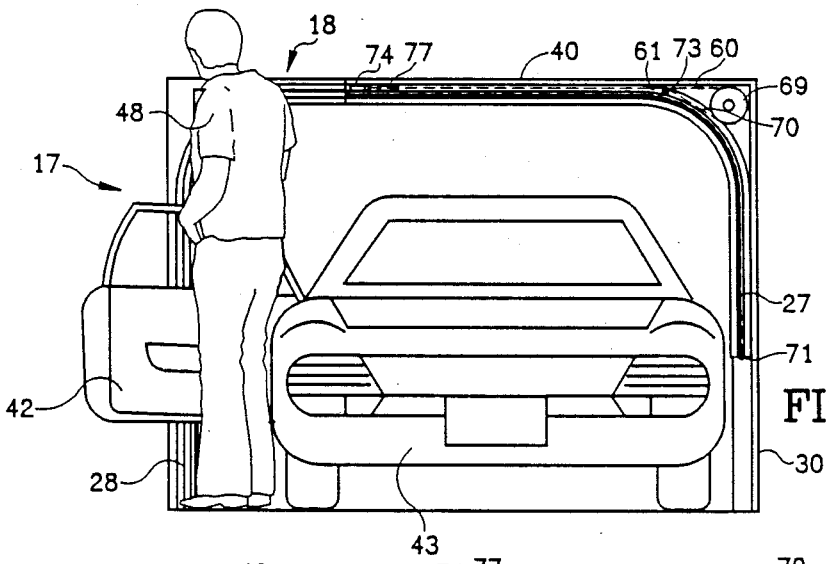
FIG. 4
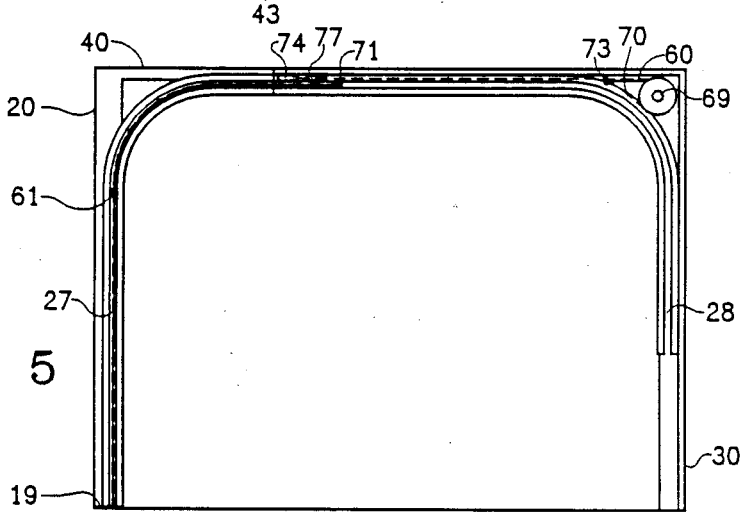
FIG. 5

AUTOMOBILE ENCLOSURE

BACKGROUND OF THE INVENTION

1. This invention relates to a lightweight, transportable, lowprofile automobile enclosure or garage and more particularly to one of low height yet of unobstructed ingress-and egress.

2. Description of the Related Art

It is often desirable to protect an automobile from the elements and from theft or vandalism. In many circumstances, permanent garages are not available; for example, in apartments, in many condominiums, at work, even at some homes.

Heretofore, none of the various attempts made to design a automobile enclosure have arrived at a suitable solution to the following problems.

Preferably, the enclosure is relatively lightweight and easily transportable s that it may be easily transported to and installed at the place of use: apartment, condominium, work, etc. Yet, the enclosure must be strong enough and heavy enough to prevent entry by theives or vandals.

Preferably, the enclosure is as small as possible so as to be unobtrusive. Preferably, a person of average height can look over the top of the enclosure so that there is no blocking of views and that persons do not feel claustrophobic being between several such enclosures.

Preferably, also, the enclosure permits a driver to ingress and egress from the automobile in a normal, full standing manner.

Preferably, the enclosure doors do not open upward, where they may encounter a carport roof or the like nor outward where they my be obstructed by another automobile.

Preferably the doors of the enclosure are easily opened by hand or by an electric motor.

It will be seen that the device of the present invention satisfys these and other criteria in a new and novel manner.

SUMMARY OF THE INVENTION

According to the invention, a portable, strong, lightweight, low-height automobile enclosure encloses an automobile on five sides. A roll up rear door provides for entry of an automobile. The driver side wall and roof include have a side access opening extending through them such that a driver taller then the roof of the enclosure can ingress and egress the driver door in a normal standing manner. A roll up side door is moveable between an closed position closing the side access opening to an open position disposed under the roof and along the passenger side wall. Side and rear doors opens simultaneously.

The door opening, closing, and locking mechanism is a pair of cable winches mounted on a shaft, each with a cable attached to the door. One winch for opening and one for closing a door. The cables are counter wound on the drums so that as one cable is played out as the other is taken in. Thus the door may not move in either direction unless the cable drums are turned.

Other features and many attendant advantages of the invention will become more apparent upon a reading of the following detailed description together with the drawings, in which like references numerals refer to like parts throughout.

BRIEF DESCRIPTION OF THE DRAWINGS

FIG. 3 is a left side view of the automobile enclosure showing an enclosed automobile in phantom.

FIG. 4 sectional view taken on line 4—4 of FIG. 3 showing the side door in the fully up position and with an automobile in the enclosure and a driver standing in the side opening.

FIG. 5 is a sectional view taken along line line 4—4 showing the side door in the fully down position.

DETAILED DESCRIPTION OF THE INVENTION

Figure 1:
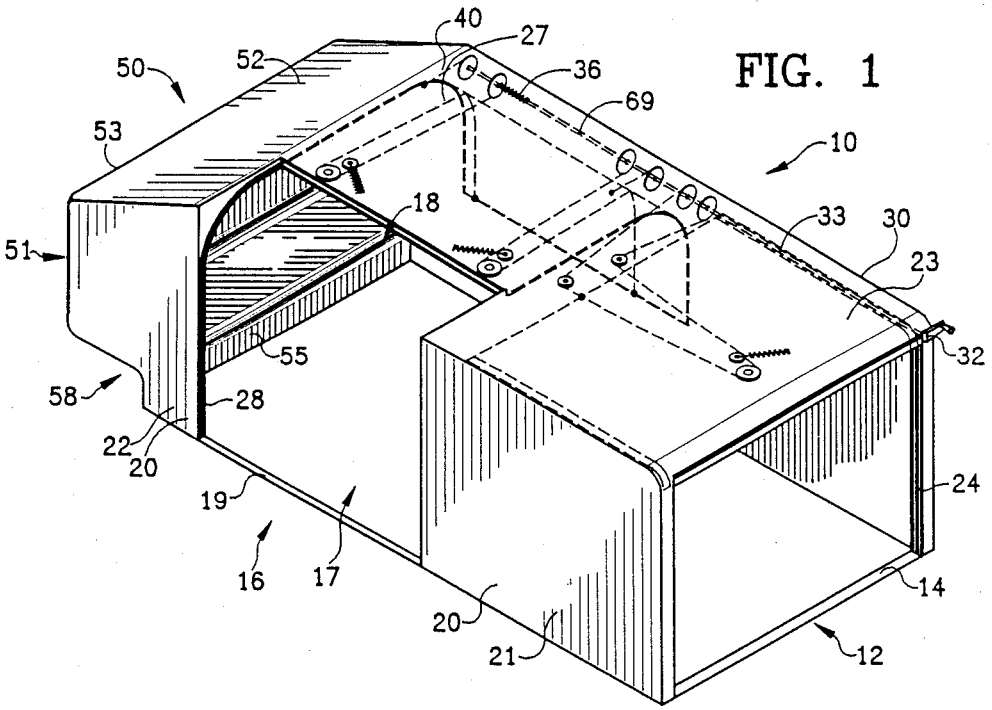
FIG. 1 is a perspective view of a preferred embodiment of the automobile enclosure of the present invention shown with the side and rear roll-up doors open.

With reference now to the drawing, and more particularly to FIGS. 1 and 3 thereof, there is shown a preferred embodiment of the automobile enclosure, denoted generally as 10, of the present invention. FIG. 1 is a perspective view of enclosure 10. FIG. 3 is a left side view of the enclosure 10 of FIG. 1 with roll up side door 27 closed and with an added enclosed automobile 3 shown in phantom.

Enclosure 10 surrounds an automobile 43 on five sides and generally includes a pair of spaced opposed upright side walls, such as driver side wall 20 and passenger side wall 30, roof 40, front closure 50, roll up rear door 23, and roll up side door 27.

Driver side wall 20 and passenger side wall 30 are joined by roof 40 to form a substantially square inverted U-shaped structure and define a rear opening 12 dimensioned for accepting automobile 43 and an opposite front end. Driver side wall 20 and roof 40 have an access opening 16 extending therethrough at a position adjacent the driver door of an automobile in the enclosure. Access opening 16 includes a side wall portion 17 which passes through driver side wall 20 and a roof portion 18 which passes through roof 40. Side access opening 16 divides side wall 20 into front and rear portions 22,21 respectively.

A front closure, denoted generally as 50, joins side walls 20,30 and roof 40 and encloses the front end of enclosure 10.

Figure 2:
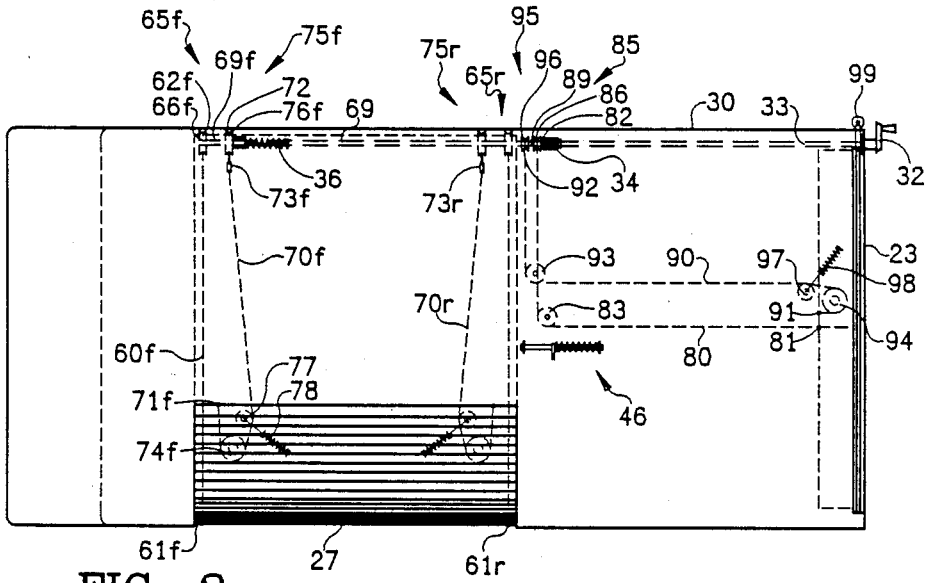
FIG. 2 is a top plan view showing the door movement mechanisms in phantom.

A roll-up side door 27 is moveable between an open position, as shown in FIG. 1 in phantom, opening the side access area 16 whereby free and normal access is provided via side access opening 16 to the driver door 42 of an enclosed vehicle 43, and a closed position closing side access opening 16, as seen in FIGS. 2 and 3. In the open position as shown in FIG. 1 in phantom, side door 27 is disposed directly under roof 40 and extends down adjacent the inside of passenger side wall 30.

A roll-up rear door 23 is moveable between an open position where it is disposed under the rear portion of roof 40, as shown in phantom in FIG. 1, for opening rear opening 12 such that automobile 43 may pass through rear opening 12, and a closed position whereby it closes rear opening 12, as seen in FIG. 2. Both roll up doors 23,27 are of well-known construction comprising a series of rigid horizontal panels hingedly connected along the long sides with some or all having a friction reducing means, such as a wheel, mounted on the outer ends.

Side door guide means, such as side door roller channels 28, provide a path of travel for side door 27. Side door roller channels 28 are mounted to enclosure 10 adjacent the front and rear sides of access opening 16 where they hold side door 27 in the closed position and they cross under roof 40 and partially down the inside of passenger side wall 30 for holding side door 27 in the open position. Channels 28 are typically made of steel channel and receive the rollers of the roll up door.

Rear door guide means, such as rear door roller channels 24, are similar in structure to the side door roller channels 78 and provide a path of travel for rear door 23. Rear door roller channels 24 are mounted to enclosure 10 adjacent each side of rear opening 12 for holding rear door 23 in the closed position and proceed forward under roof 40 for holding rear door 23 in the open position.

In the preferred embodiment, an internal frame structure, for the most part not shown, comprising mainly one and one-half inch square steel tubing one-eighth inch thick, is disposed at the periphery of the walls. Preferable, the front and rear portions 22,21 of driver side wall 20 are connected below access opening 16, by a side base connecting member, such as by steel flat stock member 19. And also preferably, driver side wall 20 and passenger side wall 30 are connected below rear opening 12, by a rear base connecting member, such as by steel flat stock member 14. Base connecting members 14,19 add considerable strength and rigidity to to the structure. Rear base connecting member 14 should be low enough in height so as to not interfere with passage of an automobile. Side base connecting member 19 should be low enough in height so as to not interfere with ingress and egress of the driver and additionally preferable is low enough so that a driver's door can open over it, as seen in FIG. 4.

Side walls 20,30, roof 40 and front closure 50 are constructed of suitable materials so as to prevent easy forced entry into enclosure 10 when doors 23,27 are down and locked. Walls of three-eighths to one half inch plywood covered with fiberglass have proven satisfactory; although, other materials are suitable. A roof of plywood covered with nineteen thousandths thick aluminum has been satisfactory. Fiberglass sheets may also be used.

Front closure 50 may be of similar materials to those described above or may be molded from glass fiber or plastic. As best seen in FIGS. 1 and 3, in the exemplary embodiment, front closure 50 is designed to project over a curb or a wheel stop 59 and therefore includes a curb riser portion, denoted generally as 58. Front closure 50 includes a front wall, denoted generally as 51 which, includes wall/roof portion 52, a front portion 53, a flat storage portion 54, and curb rise portion 55. Curb riser portion 58 allows enclosure 10 to fit in many common parking spaces where there is a curb or tire stop 59. The height of enclosure 10 is intended to be kept to a minimum. Preferably, the average person can look over the top. This is partially out of deference to aesthetics but also to promote safety and wellbeing as a person using the enclosure will be able to see other persons in the vicinity. Slanted front wall 52 also serves this purpose by not creating a blind corner and by allowing the driver to see traffic or persons before exiting next to the front of the enclosure. Flat portion 54 of front wall 51 provides an amount of off-the-ground storage depending on the particular vehicle housed.

FIG. 4 is a sectional view taken on line 4—4 of FIG. 3 with the inclusion of a driver 48 exiting automobile 43 and with the driver door 42 open. Driver 48 is taller than the height of enclosure 10 and is standing such that his head passes through the roof portion 18 of side access opening 16. Driver door 42 opens through the side wall portion 17 of side access opening 16. As seen in FIGS. 1 and 4, side access opening 16 extends well into the roof 40 of enclosure 10 so as to provide free and normal access to the driver door 42 of an enclosed automobile 43, even for a driver 48 taller than enclosure 10.

FIG. 2 is a top plan view showing the door movement mechanisms in phantom. As seen in FIG. 2, rear door 23 has opening, closing, and locking means for opening and closing it and for locking it in the closed position. Rear door opening means includes a rear door opening winch, denoted generally as 85, comprising rear door opening cable 80 and rear door opening cable drum 86. Cable 80 has a first end 81 connected to the top center of rear door 23 and a second end 82 attached to drum 86. Cable 80 passes around change-of-direction pulley 83 which is mounted to the bottom of roof 40. Drum 86 is mounted on rotatable rear door shaft 89 mounted in journals (not shown) attached to enclosure 10 in the juncture corner of the roof 40 and passenger side wall 30.

Means for activating rear door shaft 89 and thus winch 85 so as to open rear door 23 include crank 32 and crank shaft 33 journally mounted to enclosure 10. Crank shaft 33 terminates in a reduction gear assembly 34 which powers rear door shaft 89. Others are prevented from using crank 32 by making it removable or by including means for locking it from turning.

Means for locking rear door 23 in the closed position includes a rear door locking winch, denoted generally as 95, comprising rear door locking cable 90 and rear door locking cable drum 96. Cable 90 has a first end 91 connected to the top center of rear door 23 and a second end 92 wound to drum 96. Cable 90 passes around change-of-direction pulley 93 which is mounted to the bottom of roof 40 and around reverse direction pulley 94, also mounted on bottom of roof 40. Tensioner pulley 97 and spring 98, mounted from the roof 40, take up slack in cable 90. Cable 90 is wound on drum 96 counter to cable 80 wound on drum 86 so that upon rotation of shaft 89 cable 80 is wound on drum 86 to open rear door 23 while cable 90 is unwound from drum 96 thus allowing door 23 to open. Reversing rotation of shaft 89 reverses this process and cable 90 closes door 23 while cable 80 serves as a brake. As can be seen, locking cable 90 prevents rear door 23 from being opened and rear door 23 cannot be opened without turning shaft 89.

Alternative means for locking rear door 23 in the closed position and for closing rear door 23 are also shown and include locking pin 99 passing through enclosure 10 and into rear door roller channel 24 and secured in position by means such as a key lock. Associated rear door opening means include biasing means, such as spring biasing means 46 attached to the underside of roof 40, for getting the door started closing, that is getting part of door 23 into opening 12 so that the remainder will feed by the force of gravity to totally close rear door 23.

Side door 27 has opening, closing, and locking means for opening and closing side door 27 and for preventing the door form being opened from the outside and for locking it in the closed position. These are best seen in FIGS. 2, 4, and 5. In the preferred embodiment shown, the side door opening, closing and locking features are shown as a pair, one set of the pair being attached to each side, i.e. frontmost and rearmost, of side door 27. In the following detailed description, the suffix "f" denotes the frontmost one of the pair and the suffix "r" denotes the rearmost on of the pair. The paired system shown is preferable in some substantiations of the enclosure as it prevents the door from binding. However, it can be seen that a single opening, closing and locking system attached say to the center of side door 27 can be substituted for the paired system, illustrated.

FIG. 4 is a sectional view taken on line 4—4 of FIG. 3. showing side door 27, in bold dashed lines, in the fully up position. FIG. 5 is a sectional view taken along line line 4—4 showing side door 27, in bold dashed lines, in the fully down position.

Side door opening means includes a side door opening winch, denoted generally as 65*f*, comprising side door opening cable 60*f* and side door opening cable drum 66*f*. Cable 60 has a first end 61*f* connected to side door 27 and a second end 62*f* attached to drum 66*f*. Cable 60*f* is wound on drum 66*f* so as to feed off the top near to the underside of roof 40. Drum 66 is mounted on rotatable side door shaft 69*f* mounted in journals (not shown) attached to enclosure 10 in the juncture corner of the roof 40 and passenger side wall 30. Rotation of shaft 69*f* rotates drum 66*f* for opening side door 27.

Means for activating side door shaft 69*f* and thus winch 65*f* so as to open side door 27 include connecting shaft 69 connected to the rear door opening means, namely to winch 85, journally mounted to enclosure 10. Shafts 69*f*, 69, and 89 may be a single shaft.

Means for locking side door 27 in the closed position includes a side door locking winch, denoted generally as 75*f*, comprising side door locking cable 70*f* and side door locking cable drum 76*f*. Cable 70*f* has a first end 71*f* connected to the top of side door 27 and a second end 72*f* wound to drum 76*f* counter to the direction that opening cable 60*f* is wound on drum 66*f*. Cable 70*f* passes around change-of-direction pulley 73*f* which is attached to roof 40 for getting cable 70*f* to travel above the door travel position. Cable 70*f* passes around reverse direction pulley 74*f*, also mounted on bottom of roof 40. Tensioner pulley 77*f* and spring 78*f*, mounted from the roof 40, take up slack in cable 70*f*. Shaft 69*f* couples side door opening drum 66*f* with side door closing drum 76*f* for turning both in unison. Cable 70*f* is wound on drum 76*f* counter to cable 60*f* wound on drum 66*f* so that upon rotation of shaft 69*f* cable 60*f* is wound on drum 66*f* to open side door 27 while cable 70*f* is unwound from drum 76*f* thus allowing door 27 to open. Reversing rotation of shaft 69*f* reverses this process and cable 70*f* closes door 27 while cable 60*f* serves as a brake. As can be seen, locking cable 70*f* prevents side door 27 from being opened and side door 27 cannot be opened without the turning shaft 69*f*.

The rearmost set of the side door opening, closing and locking members are a mirror image of the above-described frontmost members and are designated on the drawing by the same number with the suffix "r".

Biasing means, such as torsion spring 36, on shaft 69 is approximately neutrally biased when door 27 has no gravitational open or close biasing force and is biased toward opening door 27 from the fully closed position and toward closing door 27 from the fully open position.

An alternative method of activating the door open/-close elements is driving shaft 89 with an electric motor (not shown). The electric motor could be powered by a battery and the battery could be charged by a solar panel on roof 40. Radio activation means, such as commonly used on electric garage door openers, attached to the electric motor could activate the motor for opening and closing the doors.

From the foregoing description, it can be seen that the present invention provides a lightweight, easily transportable, and compact housing for an automobile.

Although a particular embodiment of the invention has been illustrated and described, various changes may be made in the form, construction, and arrangement of the parts herein without sacrificing any of its advantages. Therefore, it is to be understood that all matter herein is to be interpreted as illustrative and not in any limiting sense, and it is intended to cover in the appended claims such modification and changes as as come within the true spirit and scope of the invention.

I claim:

1. An automobile housing of low height providing improved access for a person whose height is greater than the roof of the housing; said housing comprising:

an enclosure for surrounding an automobile on five sides including:

a pair of spaced opposed upright side walls including:

a driver side wall; and a passenger side wall; and a roof joining said side walls; said side walls and said roof being substantially inverted U-shaped in cross section and defining a rear opening dimensioned for accepting an automobile and an opposite front end; said driver side wall and said roof having a side access opening extending therethrough for providing free and normal standing access to an enclosed automobile driver door;

a front end closure joining said side walls and said roof at the front end of said enclosure;

a roll-up side door mounted in a side door guide means and moveable between a closed position closing said side access opening and an open position opening said side access opening and thereat providing free and normal standing access to an enclosed automobile driver door; and a roll-up rear door mounted in a rear door guide means and moveable between a closed position closing said rear opening and an open position opening said rear opening for accepting an automobile; and side door guide means mounted to said enclosure adjacent the sides of said side access opening and crossing under said roof for providing a path of travel for said side door; and rear door guide means mounted to said enclosure adjacent the sides of said rear door and proceeding forward under said roof for providing a path of travel for said rear door.

2. The automobile housing of claim 1 wherein:

said side door guide means extends at least partially down the inside of said passenger side wall for providing a path of travel for said side door; and said side door, in the open position, extends partially down the inside of said passenger side wall.

3. The automobile housing of claim 1 including:

side door opening means connected to said enclosure and to said side door for opening said side door.

4. The automobile housing of claim 3 including:

side door closing means connected to said side door and mounted inside said enclosure.

5. The automobile housing of claim 1 including:

rear door opening means connected to said enclosure and to said rear door for opening said rear door.

6. The automobile housing of claim 5 wherein:

said rear door opening means is mounted inside said enclosure.

7. The automobile housing of claim 1 including:

side door opening means connected to said enclosure and to said side door for opening said side door;

rear door opening means connected to said enclosure and to said rear door for opening said rear door; and linking means located within said enclosure and operatively connected to said side door opening means and said rear door opening means for simultaneously opening said side door and said rear door.

8. An automobile housing of low height providing improved access for a person whose height is greater than the roof of the housing; said housing comprising:

an enclosure for surrounding an automobile on five sides including:

a pair of spaced opposed upright side walls including:

a driver side wall; and a passenger side wall; and a roof joining said side walls;

said side walls and said roof being substantially inverted U-shaped in cross section and defining a rear opening dimensioned for accepting an automobile; said driver side wall and said roof having a side access opening extending therethrough for providing free and normal standing access to an enclosed automobile driver door;

a front end closure;

a roll-up side door mounted in a side door guide means and moveable between a closed position closing said side access opening and an open position opening said side access opening and thereat providing free and normal standing access to an enclosed automobile driver door; and a roll-up rear door mounted in a rear door guide means and moveable between a closed position closing said rear opening and an open position opening said rear opening for accepting an automobile; and side door guide means mounted to said enclosure adjacent the sides of said side access opening and crossing under said roof for providing a path of travel for said side door;

rear door guide means mounted to said enclosure adjacent the sides of said rear door and proceeding forward under said roof for providing a path of travel for said rear door;

side door locking cable means within said enclosure including:

a side door locking cable connected to said side door and to a side door locking cable retention means; and side door locking cable retention means for retaining said side door locking cable such that said side door locking cable must be played out by said side door locking cable retention means for said side door to open.

9. The automobile housing of claim 8 wherein:

said side door guide means extends at least partially down the inside of said passenger side wall for providing a path of travel for said side door; and said side door, in the open position, travels at least partially down the inside of said passenger wall.

10. The automobile housing of claim 8 including:

side door opening means connected to said side door for opening said side door; and activating means connected to said side door opening means for activating said side door opening means so as to open said side door.

11. The automobile housing of claim 10 including:

coupling means between said side door opening means and said side door locking cable means such that said side door locking cable retention means will play out cable when said side door opening means is activated.

12. The automobile housing of claim 8 including:

rear door locking means for locking said rear door in the closed position.

13. The automobile housing of claim 12 wherein:

said rear door locking means includes rear door locking cable means within said enclosure including:

a rear door locking cable connected to said rear door and to a rear door locking cable retention means; and rear door locking cable retention means for retaining said rear door locking cable such that said rear door locking cable must be played out by said rear door locking cable retention means for said rear door to open.

14. An automobile housing of low height providing improved access for a person whose height is greater than the roof of the housing; said housing comprising:

an enclosure for surrounding an automobile on five sides including:

a pair of spaced opposed upright side walls including:

a driver side wall; and a passenger side wall; and a roof joining said side walls; said side walls and said roof being substantially inverted U-shaped in cross section and defining a rear opening dimensioned for accepting an automobile and an opposite front end; said driver side wall and roof having a side access opening extending therethrough for providing free and normal standing access to an enclosed automobile driver door;

a front end closure joining said side walls and said roof at the front of said enclosure;

a roll-up side door mounted in a side door guide means and moveable between a closed position closing said side access opening and an open position opening said side access opening nd thereat providing free and normal standing access to an enclosed automobile driver door; and a roll-up rear door mounted in a rear door guide means and moveable between a closed position closing said rear opening and an open position opening said rear opening for accepting an automobile; and side door guide means mounted to said enclosure adjacent the sides of said side access opening and crossing under said roof for providing a path of travel for said side door;

rear door guide means mounted to said enclosure adjacent the sides of said rear door and proceeding forward under said roof for providing a path of travel for said rear door;

side door opening winch means for opening said side door comprising:

a side door opening cable including:

a first end connected to said side door; and a second end;

a side door opening cable drum retaining said side door opening cable second end and being rotatable such that, upon winding said side door opening cable thereon, said side door is opened;

side door opening activation means connected to said side door opening winch means for activating said side door opening winch means so as to open said side door;

side door locking winch means within said enclosure including:

a side door locking cable having a first end connected to said side door and a second end; and a side door locking drum retaining said side door locking cable second end such that said side door locking cable must be unwound by said side door locking drum for said side door to open and being rotatable such that unwinding permits said side door to be opened; and coupling means coupling said side door opening winch means and said side door locking winch means such that said side door locking cable drum unwinds when said side door opening winch is activated by said activation means and said side door opening drum winds.

15. The automobile housing of claim 14 wherein:

said coupling means is a side door shaft; and said side door locking cable drum and said side door opening cable drum are mounted on said side door shaft and counter wound.

16. The automobile housing of claim 14 including:

rear door locking means for locking said rear door in the closed position;

rear door opening means for moving said rear door to the open position; and rear door activating means connected to said rear door opening means for activating said rear door opening means so as to open said rear door.

17. The automobile housing of claim 16 including:

linking means linking said rear door opening means with said side door activating means such that opening said rear door opens said side door.

18. The automobile housing of claim 16 wherein:

said rear door locking means comprises:

a rear door locking winch within said enclosure including:

a rear door locking cable having a first end connected to said rear door and a second end; and a rear door locking drum retaining said rear door locking cable second end such that said rear door locking cable must be unwound by said rear door locking drum for said rear door to open and being rotatable such that unwinding permits said rear door to be opened; and rear door coupling means coupling said rear door opening winch and said rear door locking winch such that said rear door locking drum unwinds when said rear door opening winch is activated by said rear door activation means and said rear door opening drum winds said rear door opening cable.

19. An automobile housing of low height providing improved access for a person whose height is greater than the roof of the housing; said housing comprising:

an enclosure for surrounding an automobile on five sides including:

a pair of spaced opposed upright side walls including:

a driver side wall; and a passenger side wall; and a roof joining said side walls; said side walls and said roof being substantially inverted U-shaped in cross section and defining a rear opening dimensioned for accepting an automobile an an opposite front end; said driver side wall and roof having a side access opening extending therethrough for providing free and normal standing access to an enclosed automobile driver door;

a front end closure joining said said roof at the front end of said enclosure;

a roll-up side door mounted in a side door guide means and moveable between a closed position closing said side access opening and an open position opening said side access opening and providing free and normal standing access to an enclosed automobile driver door; and a roll-up rear door mounted in a rear door guide means and moveable between a closed position closing said rear opening and an open position opening said rear opening for accepting an automobile;

side door guide means mounted to said enclosure adjacent the sides of said side access opening and crossing under said roof for providing a path of travel for said side door;

rear door guide means mounted to said enclosure adjacent the sides of said rear door and proceeding forward under said roof for providing a path of travel for said rear door;

side door opening, closing and locking means for opening and closing said side door and for locking said side door in the closed position comprising:

a side door shaft rotatably mounted in said enclosure;

side door opening winch means for opening said side door comprising:

a side door opening cable including:

a first end connected to said side door; and a second end:

a side door opening cable drum mounted on said side door shaft and retaining said side door opening cable second end and rotatable with said side door shaft such that winding said side door opening cable onto said side door opening drum opens said side door;

side door locking winch means within said enclosure including:

a side door locking cable having a first end connected to said side door and a second end; and a side door locking drum mounted on said side door shaft and retaining said side door locking cable second end wound counter to said side door opening drum cable such that said side door locking cable must be unwound from said side door locking drum for s id side door to open and being a rotatable with said shaft such that unwinding permits said side door to be opened;

rear door locking means for locking said rear door in the closed position;

rear door opening means connected to said rear door for moving said rear door from the closed position to the open position; and linking means linking said rear door opening means with said side door opening, closing and locking means such that opening said rear door opens said side door and closing said rear door closes said side door.

20. The automobile housing of claim 19 wherein:

said rear door locking means comprises:

a rear door shaft;

a rear door locking winch within said enclosure including:

a rear door locking cable having a first end connected to said rear door and a second end; and a rear door locking drum mounted on said rear door shaft and retaining said rear door locking cable second end such that said rear door locking cable must be unwound from said rear door locking drum for said rear door to open and being rotatable with said shaft such that unwinding said permits said rear door to be opened; and rear door coupling means coupling said rear door opening means and said rear door locking winch such that said rear door locking drum unwinds when said rear door opening means opens said rear door.

21. The automobile housing of claim 20 wherein:

said rear door opening means comprises:

a rear door opening winch means for opening said rear door comprising:

a rear door opening cable including:

a first end connected to said rear door; and a second end;

a rear door opening cable drum mounted on said rear door shaft and retaining said rear door opening cable second end wound counter to said rear door locking cable and rotatable with said rear door shaft such that winding said rear door opening cable onto said rear door opening drum opens said rear door.

* * * * *